US006554296B1

(12) United States Patent
Laughlin et al.

(10) Patent No.: US 6,554,296 B1
(45) Date of Patent: Apr. 29, 2003

(54) HIGHBACK WITH INDEPENDENT FORWARD LEAN ADJUSTMENT

(75) Inventors: James D. Laughlin, Burlington; David J. Dodge, Williston, both of VT (US)

(73) Assignee: The Burton Corporation, Butlington, VT (US)

( * ) Notice: Subject to any disclaimer, the term of this patent is extended or adjusted under 35 U.S.C. 154(b) by 0 days.

(21) Appl. No.: 09/560,941

(22) Filed: Apr. 28, 2000

(51) Int. Cl.[7] ..... B62B 9/04
(52) U.S. Cl. ..... 280/14.22; 280/618
(58) Field of Search ..... 36/118.2, 118.3, 36/118.4, 118.7, 118.8, 118.9; 280/624, 617, 618, 14.21, 11.36, 14.22

(56) References Cited

U.S. PATENT DOCUMENTS

| | | | | |
|---|---|---|---|---|
| 3,775,872 A | | 12/1973 | Rathmell | 36/2.5 |
| 3,798,800 A | | 3/1974 | Rathmell | 36/2.5 |
| 4,168,084 A | | 9/1979 | von Besser et al. | 280/618 |
| 4,188,046 A | | 2/1980 | Fleckenstein | 280/618 |
| 4,265,034 A | | 5/1981 | Salomon | 36/121 |
| 4,379,370 A | | 4/1983 | Balbinot | 36/121 |
| 4,499,676 A | | 2/1985 | Chalmers, II | 36/120 |
| 4,565,017 A | | 1/1986 | Ottieri | 36/117 |
| 4,669,202 A | | 6/1987 | Ottieri | 36/117 |
| 4,905,385 A | | 3/1990 | Perrissoud | 36/120 |
| 4,910,892 A | | 3/1990 | Perrissoud | 36/120 |
| 4,945,660 A | | 8/1990 | Perrissoud | 36/120 |
| 5,020,823 A | | 6/1991 | Bogner | 280/634 |
| 5,088,211 A | | 2/1992 | Walkhoff | 36/117 |
| 5,143,396 A | | 9/1992 | Shaanan et al. | 280/607 |
| 5,216,826 A | | 6/1993 | Chaigne et al. | 36/117 |
| 5,261,689 A | | 11/1993 | Carpenter et al. | 280/618 |
| 5,356,170 A | * | 10/1994 | Carpenter et al. | 280/618 |
| 5,435,080 A | | 7/1995 | Meiselman | 36/117 |
| 5,505,477 A | | 4/1996 | Turner et al. | 280/613 |
| 5,647,148 A | | 7/1997 | Meiselman | 36/115 |

(List continued on next page.)

FOREIGN PATENT DOCUMENTS

| | | |
|---|---|---|
| EP | 0 824 942 A1 | 2/1998 |
| FR | 2 758 469 A1 | 7/1998 |
| WO | WO 00/21621 A1 | 4/2000 |

OTHER PUBLICATIONS

Distributor Information/Sales Manual 94/95, "Binding Technology", 5 pages, Jan. 1994.
Photographs of a "STRUTBAK" snowboard binding, Santa Cruz Snowboards, 3 sheets (undated–see part II of IDS).

*Primary Examiner*—Brian L. Johnson
*Assistant Examiner*—G B Klebe
(74) *Attorney, Agent, or Firm*—Wolf, Greenfield & Sacks P.C.

(57) ABSTRACT

A highback for controlling a gliding board, such as a snowboard, through leg movement of a rider. The highback is comprised of an upright support member including at least two portions that are to be contacted by and to support a rear portion of the rider's leg and that are movable relative to each other for setting a desired forward lean of the highback. The support member may include a lower portion with a pair of mounting locations for mounting the highback to a gliding board component, such as a snowboard binding, and an upper portion movably supported by the lower portion to vary the forward lean of the highback. The highback may include a forward lean adjuster that that prevents the upper portion from moving in the heel direction beyond a predetermined forward lean position. The forward lean adjuster may be coupled to the upper portion and the lower portion of the highback to maintain the upper portion in the selected forward lean position independent of the gliding board component. A ride/relax feature may be provided to allow a rider to place the highback in either a ride mode in which the highback is fixed in the preselected forward lean position or a relax mode in which the highback is unrestrained so that leg movement is permitted in the heel direction beyond the forward lean position. A locking arrangement may also be provided to lock the highback in an upright riding position to prevent toe-edge travel relative to the board for enhanced board response.

60 Claims, 10 Drawing Sheets

U.S. PATENT DOCUMENTS 5,727,797 A * 3/1998 Bowles ..... 280/14.2
5,802,741 A 9/1998 Turner et al. ..... 36/117.3
5,890,730 A 4/1999 Anderson et al. ..... 280/624
5,899,483 A 5/1999 Paris ..... 280/611
5,906,058 A 5/1999 Rench et al. ..... 36/117.1
5,909,886 A 6/1999 Tugutaka et al. ..... 280/14.2
5,909,894 A 6/1999 Meader et al. ..... 280/623
5,915,821 A * 6/1999 Okajima et al. ..... 36/117.1
5,926,979 A 7/1999 Borel ..... 36/115
5,971,422 A 10/1999 Anderson et al. ..... 280/624
5,975,557 A 11/1999 Snoke et al. ..... 280/624
5,979,082 A 11/1999 Pallatin ..... 36/118.2
5,984,325 A 11/1999 Acuna ..... 280/14.2
5,997,027 A 12/1999 Jungkind ..... 280/617
6,003,893 A 12/1999 Hansen ..... 280/624
6,007,077 A 12/1999 Moe ..... 280/14.2
6,027,136 A 2/2000 Phillips ..... 280/618
6,032,974 A 3/2000 Saillet
6,056,300 A 5/2000 Carpenter et al. ..... 280/14.2
6,099,018 A 8/2000 Maravetz et al. ..... 280/624
6,101,745 A 8/2000 Gradin et al. ..... 36/118.7
6,102,429 A 8/2000 Laughlin et al. ..... 280/617
6,105,993 A 8/2000 Gignoux ..... 280/613
6,113,127 A 9/2000 Karol ..... 280/618
6,116,634 A 9/2000 Mometti ..... 280/613
6,116,635 A 9/2000 Rigal ..... 280/618
6,123,354 A 9/2000 Laughlin et al. ..... 280/617
6,231,057 B1 * 5/2001 Reuss et al. ..... 280/14.21
6,231,066 B1 * 5/2001 Okajima ..... 280/623
6,247,252 B1 * 6/2001 Parisotto ..... 36/118.7
6,267,403 B1 * 7/2001 Bossin et al. ..... 280/625
6,283,482 B1 * 9/2001 Coulter ..... 280/14.22

* cited by examiner

HIGHBACK WITH INDEPENDENT FORWARD LEAN ADJUSTMENT

BACKGROUND OF THE INVENTION

1. Field of the Invention

The present invention relates generally to a highback for gliding sports, such as snowboarding, and, more particularly, to a highback with independent forward lean adjustment.

2. Description of the Related Art

Snowboard binding systems for soft snowboard boots typically include an upright member, called a "highback" (also known as a "lowback" and a "SKYBACK"), that is contacted by the rear portion of a rider's leg. The highback, which may be mounted to a binding or a boot, acts as a lever that helps transmit forces directly to and from the board, allowing the rider to efficiently control the board through leg movement. For example, flexing one's legs rearward against the highback places the board on its heel edge with a corresponding shift in weight and balance acting through the highback to complete a heelside turn.

Known highbacks generally include an upright support member formed with a pair of lateral ears that are employed to pivotally mount the highback in a heel-to-toe direction along a mounting axis that is transverse to the longitudinal axis of the binding or boot. In some instances, the highback may also be mounted for lateral rotation about a substantially vertical axis, as disclosed in U.S. Pat. No. 5,356,170, which is assigned to The Burton Corporation, to accommodate a particular stance angle of the binding relative to the board.

A snowboard rider's leg is generally held by the highback at a forward angle relative to the board for balance, control and to ensure the rider's knee is bent for better shock absorption, particularly when landing jumps. To hold the rider's leg in such a stance, the highback is typically inclined relative to the board in a position referred to as "forward lean". A desired amount of forward lean is set by pivoting the highback in the toe direction about the mounting axis and adjusting the position of a forward lean actuator along the back of the highback so that it engages a portion of the binding, typically the heel hoop, to prevent movement of the highback in the heel direction beyond the desired forward lean angle.

A rider may find it desirable to lock the highback in an upright riding position on the binding to prevent toe-edge travel relative to the board for enhanced board response. An example of a binding incorporating a locking device to prevent toe-edge travel of a highback is described in U.S. Pat. No. 6,027,136, which is assigned to The Burton Corporation.

It is an object of the present invention to provide an improved highback.

SUMMARY OF THE INVENTION

In one illustrative embodiment of the invention, a highback is provided for use with a component, such as a gliding board binding, a boot or a binding interface, that interfaces with a rider's leg and is supportable by a gliding board. The highback comprises an upright support member that is constructed and arranged to support a rear portion of the rider's leg. The support member includes a lower portion and an upper portion movably supported by the lower portion. The lower portion is constructed and arranged to mount the highback to the gliding board component about a mounting axis. The upper portion is adjustable relative to the lower portion in a plurality of positions to vary an amount of forward lean of the highback. The highback further comprises a forward lean adjuster that is attached to the upper portion to maintain the upper portion in a selected one of the plurality of positions to fix the amount of forward lean of the highback.

In another illustrative embodiment of the invention, the highback comprises a ride/relax actuator that is coupled to the upper portion and the lower portion of the support member. The ride/relax actuator has a ride mode and a relax mode. In the ride mode, the upper portion is fixed in a predetermined forward lean position relative to the lower portion to prevent leg movement in a heel direction beyond the forward lean position so that leg movement in the heel direction is transmitted through the highback into the gliding board component. In the relax mode, the upper portion is unrestrained relative to the lower portion so that leg movement is permitted in the heel direction beyond the forward lean position.

In a further illustrative embodiment of the invention, a snowboard binding is provided for securing a snowboard boot to a snowboard. The binding comprises a baseplate that is mountable to the snowboard and is constructed and arranged to receive the snowboard boot, a heel hoop supported by the baseplate, and a highback pivotally mounted to the baseplate about a mounting axis. The highback includes an upright support member that is constructed and arranged to support a rear portion of the rider's leg. The support member includes a lower portion that is pivotally mounted to the baseplate about the mounting axis and has a heel cup configured to hold a heel portion of a boot. The support member further includes an upper portion that is pivotally supported by the lower portion about a forward lean axis to vary an amount of forward lean of the highback. The forward lean axis is spaced from the mounting axis and located in close proximity to the heel hoop.

In another illustrative embodiment of the invention, a snowboard binding is provided for securing a snowboard boot to a snowboard. The binding comprises a baseplate that is mountable to the snowboard and is constructed and arranged to receive the snowboard boot, a heel hoop supported by the baseplate, and a highback pivotally mounted to the baseplate. The highback includes an upright support member constructed and arranged to support a rear portion of a rider's leg. The snowboard binding further comprises a first locking feature disposed on the highback and a second locking feature disposed on an inner surface of the heel hoop adjacent the highback, the second locking feature being constructed and arranged to engage the first locking feature to prevent toe-edge pivoting of the highback.

In a further illustrative embodiment of the invention, a forward lean adjuster is provided that is mountable to a highback for use with a gliding board component that interfaces with a rider's leg and is supportable by a gliding board, the highback including a lower portion and an upper portion movably supported by the lower portion, the lower portion having a pair of mounting location for mounting the highback to the gliding board component with the upper portion being adjustable relative to the lower portion in a plurality of positions to vary an amount of forward lean of the highback. The forward lean adjuster includes a first end that is pivotally connectable to one of the lower and upper portions and a second end that is adjustably securable to the other of the lower and upper portions to maintain the upper portion in a selected one of the plurality of positions to fix the amount of forward lean of the-highback.

In another illustrative embodiment of the invention, a snowboard binding is provided that comprises a baseplate, a heel hoop supported by the baseplate, and a highback pivotally mounted to the baseplate about a mounting axis between at least an upright riding position and a collapsed position. The baseplate is constructed and arranged to receive a snowboard boot and is mountable to a snowboard. The heel hoop includes a first forward facing surface. The highback includes an upright support member that is constructed and arranged to support a rear portion of a rider's leg. The support member includes a second forward facing surface that is substantially flush with the first forward facing surface when the highback is pivoted to the upright riding position so that the snowboard boot engages the first and second forward facing surfaces of the heel hoop and the support member.

In a further illustrative embodiment of the invention, a snowboard binding baseplate is provided for mounting a highback to support a rear portion of a rider's leg. The binding baseplate comprises a base that is mountable to a snowboard, a heel hoop supported by the baseplate, and a locking feature disposed on an inner surface of the heel hoop. The locking feature is constructed and arranged to engage with a portion of the highback to prevent toeedge pivoting of the highback.

In another illustrative embodiment of the invention, a highback is provided that is mountable to a snowboard binding baseplate having a heel hoop. The highback is pivotally mountable to the baseplate about a mounting axis. The highback comprises an upright support member that is constructed and arranged to support a rear portion of a rider's leg, and a locking feature that is disposed on a rear surface of the support member. The locking feature is constructed and arranged to engage with a corresponding locking feature on an inner surface of the heel hoop to prevent toe-edge pivoting of the highback.

BRIEF DESCRIPTION OF THE DRAWINGS

The invention will be appreciated more fully with reference to the following detailed description of illustrative embodiments thereof, when taken in conjunction with the accompanying drawings, wherein like reference characters denote like features, in which.

DETAILED DESCRIPTION

The present invention is directed to a highback for controlling a gliding board, such as a snowboard, through leg movement of a rider. The highback may be used with a component, such as a gliding board binding, a boot or a binding interface, that interfaces with a rider's leg and is supportable by the gliding board. The highback is comprised of an upright support member including an upper portion that is movable relative to a lower portion thereof for setting a desired forward lean of the highback. The support member may include a pair of mounting locations for mounting the highback to the gliding board component.

The highback may include a forward lean adjuster that that prevents the upper portion from moving in the heel direction beyond a predetermined forward lean position. The forward lean adjuster may maintain the upper portion in a selected forward lean position independent of the gliding board component.

A ride/relax feature may be provided to allow a rider to place the highback in either a ride mode in which the highback is fixed in the preselected forward lean position or a relax mode in which the highback is unrestrained so that leg movement is permitted in the heel direction beyond the forward lean position. The ride/relax feature may be combined with the forward lean adjuster in a manner that allows the highback to be placed in the relax mode without affecting the forward lean setting so that the highback is returned to the preselected forward lean position when placed in the ride mode.

A locking arrangement may also be provided to lock the highback in an upright riding position to prevent toe-edge travel relative to the board for enhanced board response. The locking arrangement may include a detent structure that locks the lower portion of the highback to the heel hoop of the binding.

Figure 1:
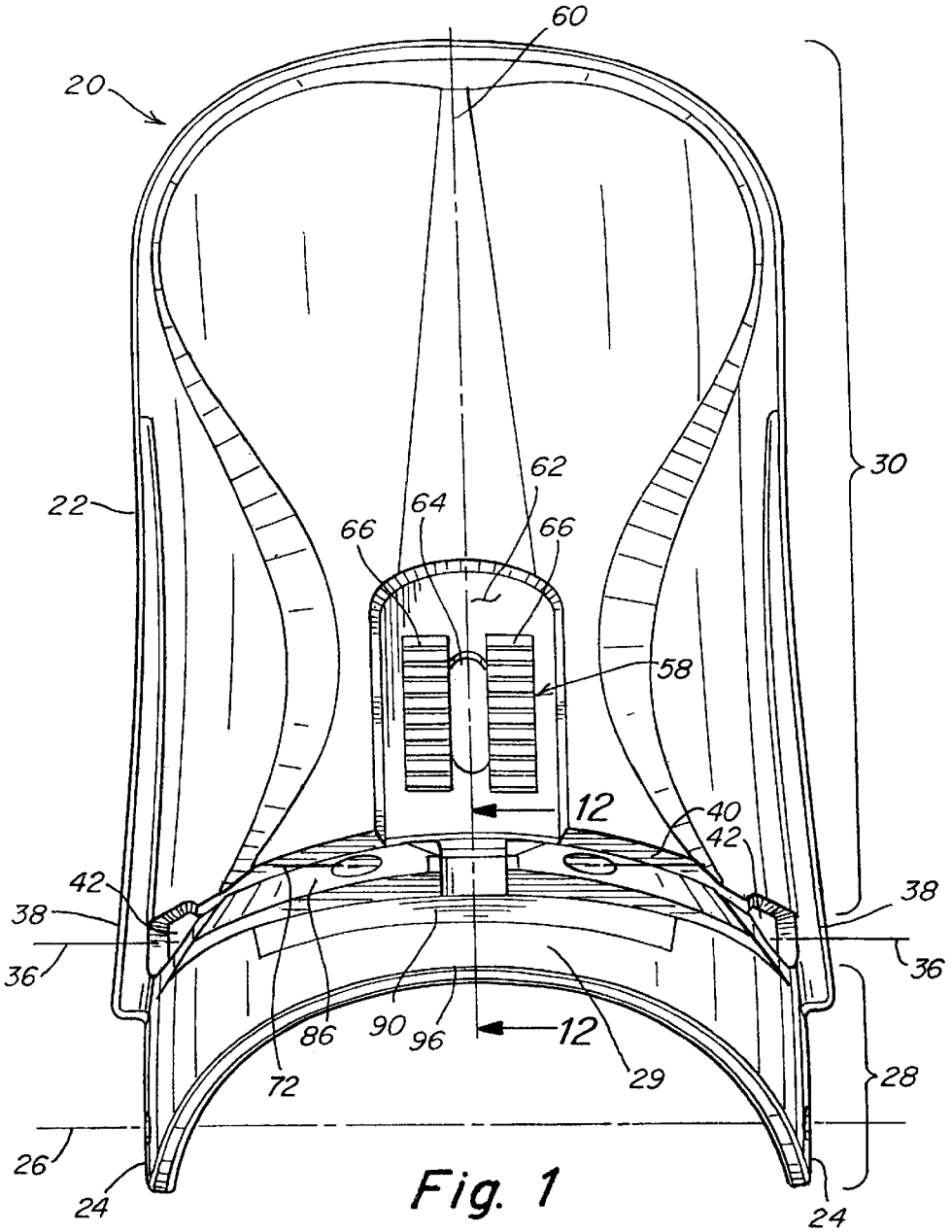
FIG. 1 is a rear view of the highback according to one illustrative embodiment of the invention.
Figure 2:
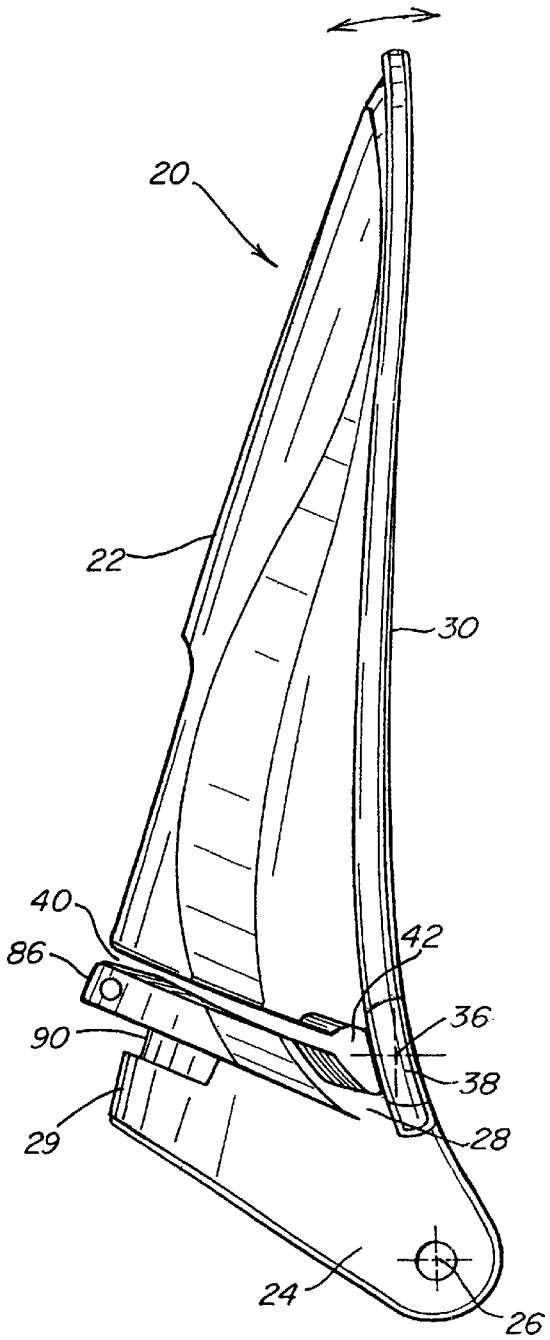
FIG. 2 is a side view of the highback of FIG. 1.
Figure 3:
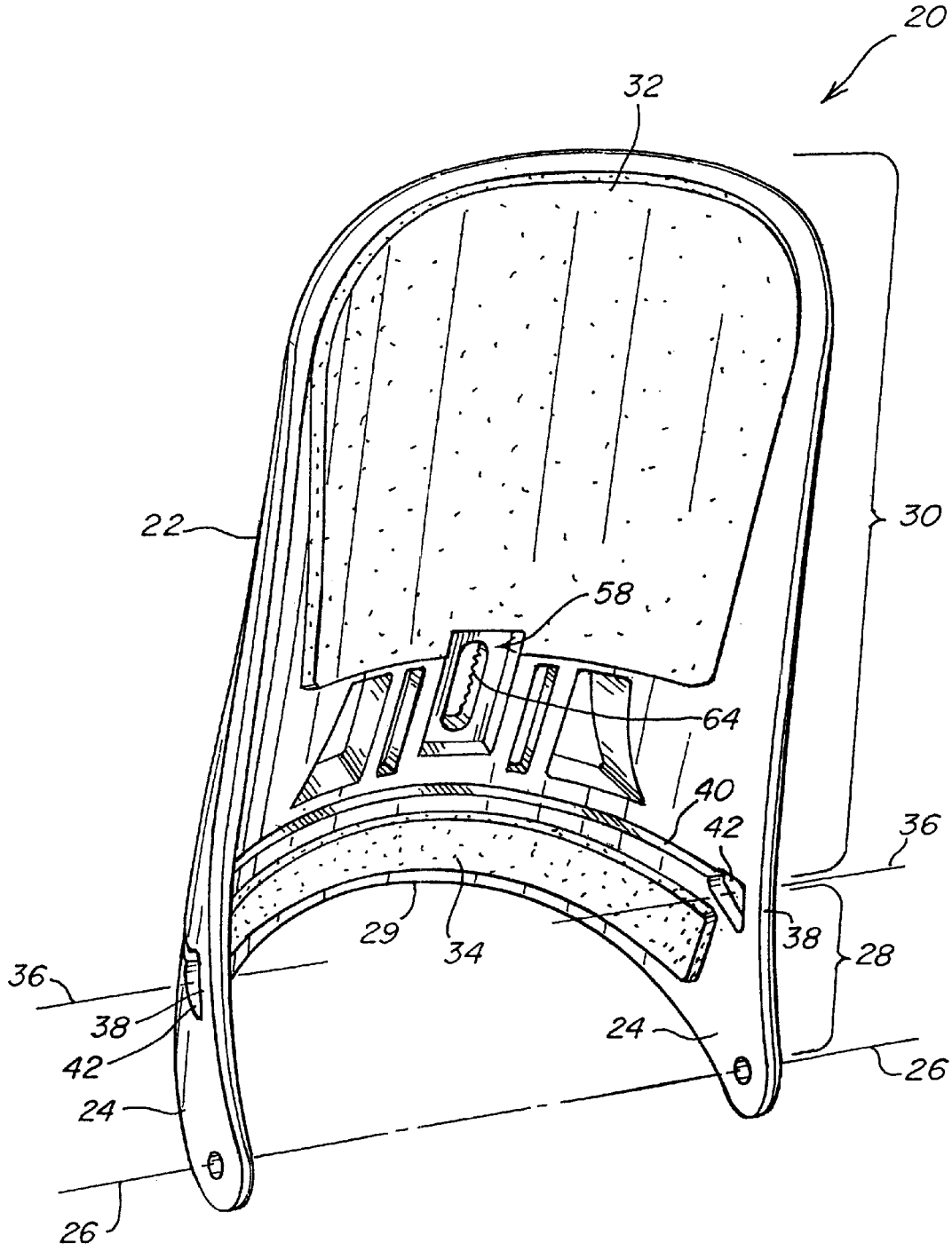
FIG. 3 is a front perspective view of the highback of FIG. 1.

In one illustrative embodiment as shown in FIGS. 1-3, the highback 20 includes an upright support member 22 and a pair of lateral ears 24 disposed on opposing sides of the support member. The lateral ears 24 provide mounting locations that may be employed to pivotally attach the highback to a gliding board component, such as a snowboard binding, a snowboard boot or a binding interface, along a mounting axis 26. The lateral ears 24 may be configured to have any shape suitable with the particular mounting arrangement for the highback.

The support member 22 preferably has a contoured configuration that is compatible with the shape of a boot. The support member 22 includes a lower portion 28 with a heel cup 29 that is configured to grip and hold the heel portion of the boot. The support member 22 also includes an upper portion 30 that is configured to extend along and to be contacted by the rear portion of the rider's leg to provide heelside support for turning and controlling the board. The inner surface of the highback may include one or more resilient pads 32, 34 to increase heel hold, to absorb shock and to facilitate pressure distribution across the boot and leg.

The upper portion 30 of the highback is adjustable in a heel-to-toe direction to allow for adjustment of the forward lean of the highback that is independent of the lower portion. More particularly, the forward lean of the highback may be adjusted without an accompanying movement of the lower portion 28 about the mounting axis 26 of the highback. Consequently, the lower portion 28 may include a heel cup 29 that conforms closely to the shape of the boot for enhanced heel hold down, since the heel cup does not need to be configured to account for the up and down or pivoting movement of the lower portion typically associated with forward lean adjustment of known highbacks.

The upper portion 30 may be movably supported by the lower portion 28 about a forward lean axis 36 that is spaced from the mounting axis 26 of the highback. In one illustrative embodiment of the invention, the highback 20 includes a hinge arrangement that allows the upper portion 30 to pivot, rotate or otherwise flex relative to the lower portion 28 about the forward lean axis 36. It is to be appreciated, however, that the upper portion may be adjustably supported by the lower portion using any suitable arrangement.

In one illustrative embodiment, the upper portion 30 is movably connected to the lower portion 28 using a living hinge 38 arrangement that is integrally formed in the highback. As shown, the highback is provided with an aperture 40, such as a slot, extending across a substantial width of the back member 22 between the upper and lower portions. The living hinge 38 is formed at each end of the slot by segments of the opposite edges of the back member 22 that interconnect the upper portion 30 to the lower portion 28. Enlarged openings 42 may be formed at the ends of the slot 40 to enhance the flexibility and, therefore, the adjustability of the upper portion relative to the lower portion. It is to be understood that any suitably configured aperture may be employed to achieve the characteristics desired for adjusting the forward lean of the highback.

Figure 4:
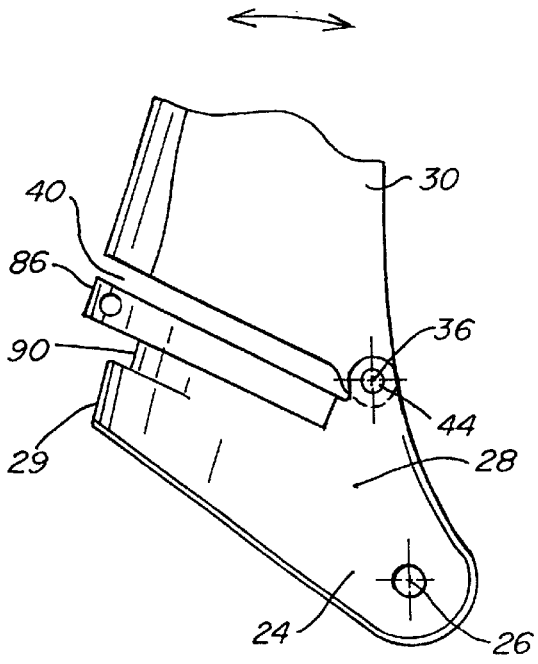
FIG. 4 is a partial side view of the highback according to another illustrative embodiment of the invention.

In another illustrative embodiment shown in FIG. 4, the upper portion 30 and the lower portion 28 may be hinged to each other using mechanical fasteners 44, such as pins, rivets, brackets and the like, that allow the upper portion to pivot or otherwise move relative to the lower portion to facilitate forward lean adjustment. In another embodiment, the mechanical fasteners may be integrally formed with the upper and lower portions. Such arrangements may be suitable if it is desired to fabricate the upper and lower portions from different materials.

It is contemplated that other joint or hinge-type arrangements may be implemented with the highback to achieve forward lean adjustment between the upper portion 30 and the lower portion 28. For example, multiple apertures may be provided between the upper and lower portions. Rather than or in addition to an aperture, a living hinge arrangement may be achieved by varying the thickness or surface texture of the back member 22 at selected locations. Adjustability between the upper and lower portions may also be implemented using various structural members or reliefs, such as ribs or grooves.

Figure 5:
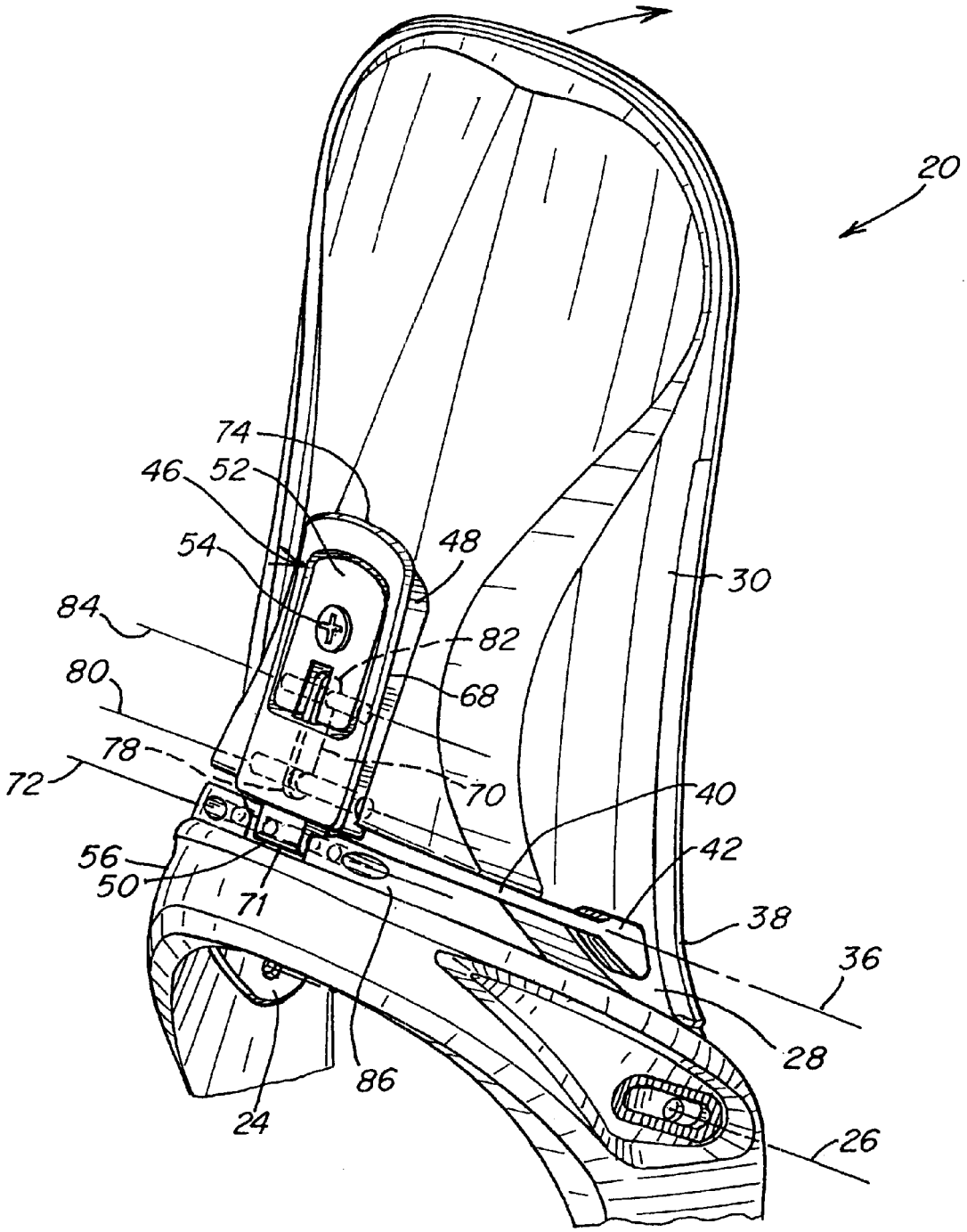
FIG. 5 is a rear perspective view of the highback of FIG. 1 illustrating the highback in a ride mode.
Figure 6:
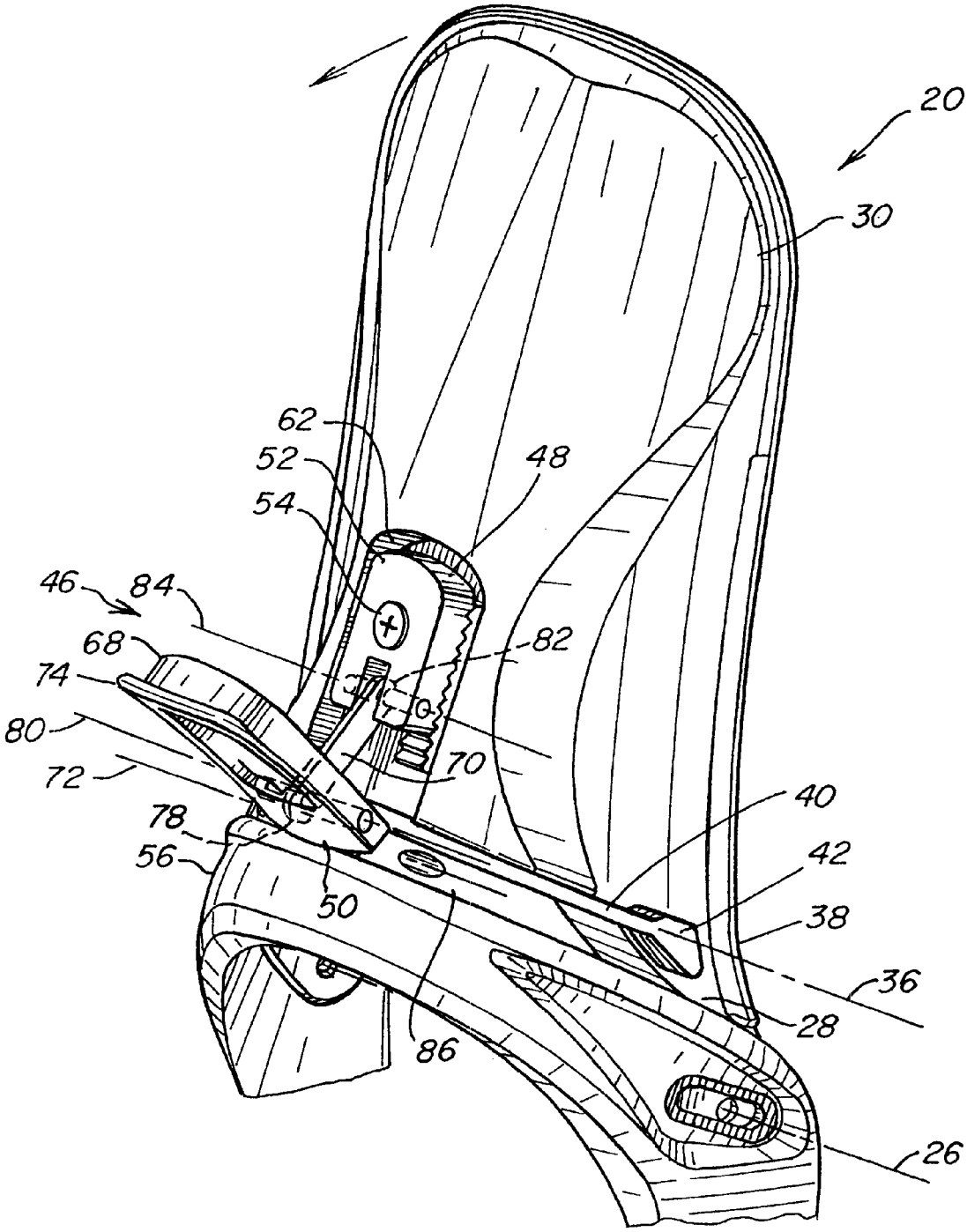
FIG. 6 is a rear perspective view of the highback of FIG. 1 illustrating the highback in a relax mode.

The forward lean of the highback 20 may be set using a forward lean adjuster that prevents the upper portion from moving in the heel direction beyond a predetermined forward lean position. In one illustrative embodiment as shown in FIGS. 5–6, a forward lean adjuster 46 is coupled to the upper portion 30 of the highback to maintain the upper portion in a selected forward lean position relative to the lower portion. An upper end 48 of the forward lean adjuster is connected to the upper portion 30 and a lower end 50 of the forward lean adjuster engages a portion of the lower portion 28 to set the forward lean of the highback independent of the gliding board component, such as a binding. As shown, the lower end 50 of the forward lean adjuster may be connected to the lower portion 28 to increase the stiffness of the highback to torsional forces.

The forward lean of the highback may be selected by adjusting the connection point between the upper end 48 of the forward lean adjuster 46 and the upper portion 30 of the back member and/or adjusting the engagement point between the lower end 50 of the forward lean adjuster and the lower portion 28 of the highback. In one embodiment, the forward lean adjuster 46 includes an adjustable block 52 that may be secured to the upper portion in a plurality of positions using any suitable fastener 54, such as a screw, pin and the like, including a tool-free fastener for quick and convenient forward lean adjustment. The forward lean of the upper portion 30 increases as the block 52 is moved in a downward direction toward the lower portion 28.

Figure 9:
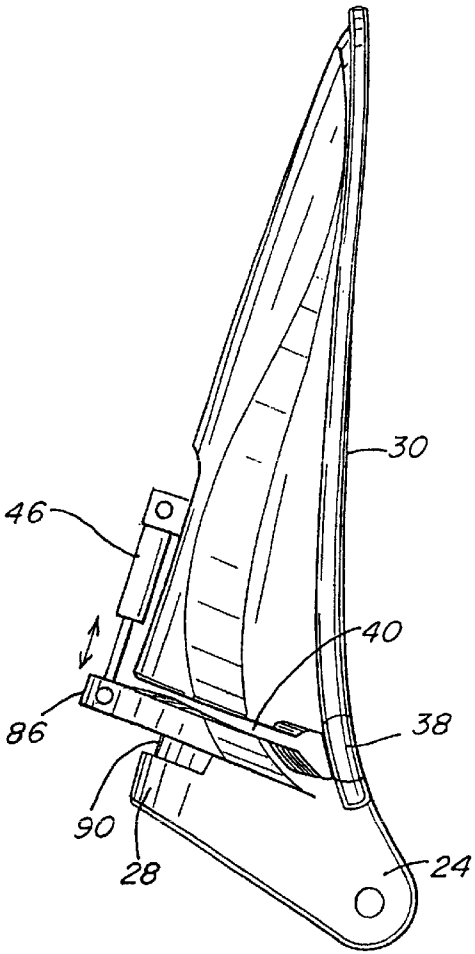
FIGS. 7–9 are side views of the highback of FIG. 1 illustrating alternative embodiments for a forward lean adjuster.
Figure 8:
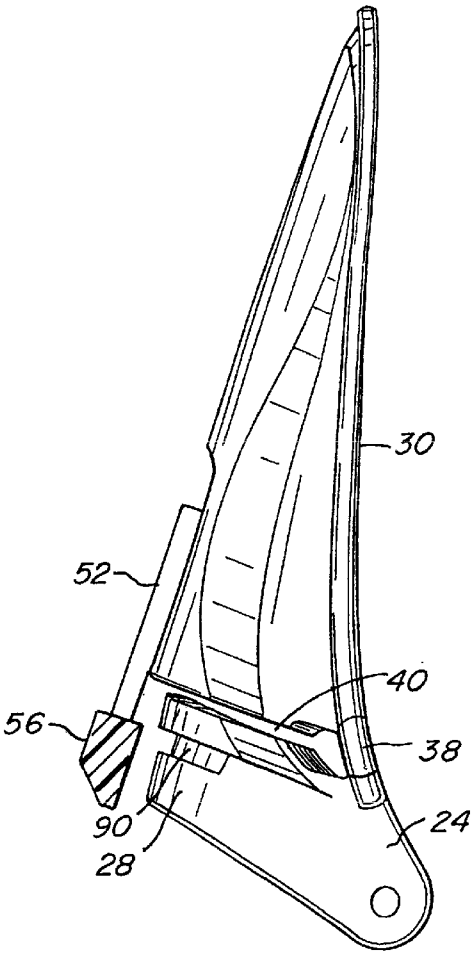
Figure 7:
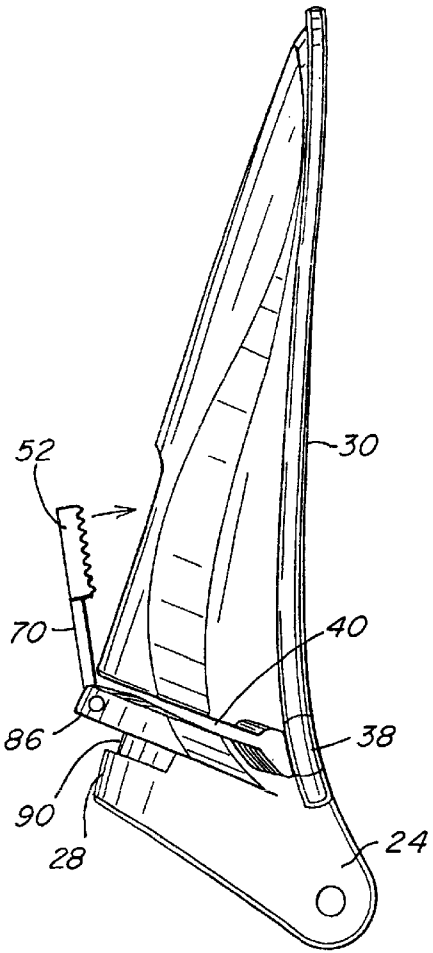
Figure 10:
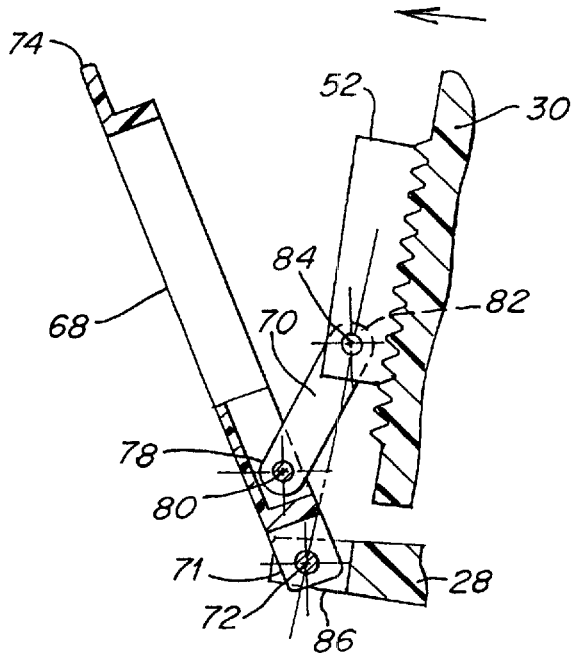
FIGS. 10–11 are schematic views of the forward lean actuator according to one illustrative embodiment in relax and ride modes, respectively.
Figure 11:
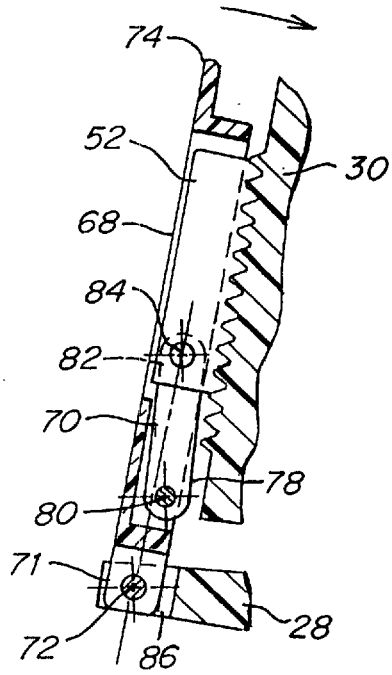

It is to be appreciated that other arrangements may be employed to adjust the forward lean of the highback. In one embodiment illustrated in FIG. 7, the block 52 may be pivotally connected to the lower portion 28 of the back member. In another embodiment illustrated in FIG. 8, the block 52 may be configured to extend across the aperture 40 and act directly on the heel hoop 56 of a binding. In a further embodiment illustrated in FIG. 9, the forward lean adjuster 46 may be configured to extend and retract so that the distance between the connection points at its upper and lower ends may be increased or decreased to adjust the amount of forward lean.

The highback 20 may include a forward lean mount 58 that is configured to receive at least a portion of the forward lean adjuster for setting the forward lean of the highback. In one illustrative embodiment as shown in FIG. 1, the mount 58 is integrally formed along the spine 60 of the support member 22 at the lower end of the upper portion 30. As shown, the mount may be disposed in a recess 62 on the upper portion 30 that is formed to receive and closely conform to the shape of the forward lean adjuster. This nested arrangement acts to increase the stiffness of the highback 20 for resisting torsional forces applied by the rider.

The forward lean mount 58 may be provided with an adjustment feature that is adapted to adjustably support the forward lean adjuster. In one embodiment, the mount 58 is provided with an elongated slot 64 along which the adjustable block 52 may positioned to set the forward lean of the highback. The mount 58, however, may be provided with any suitable structure or feature, such as a series of spaced holes, rather than or perhaps in conjunction with the slot to facilitate adjustment of the forward lean adjuster.

The forward lean mount 58 may also be provided with a plurality of locking elements 66 along the length of the mount to engage and maintain the forward lean adjuster in a desired forward lean position. In one embodiment, the locking elements 66 include a rack of teeth extending along each side of the slot 64. It is to be appreciated, however, that the locking elements 66 may include any suitable structure or feature, such as pins, holes and the like, for engaging with corresponding features on the forward lean adjuster.

The highback 20 may include a ride/relax actuator that allows a rider to place the highback in either a ride mode or a relax mode. In the ride mode, the highback is set in a preselected forward lean position to prevent leg movement in the heel direction beyond the forward lean position. In the relax mode, the highback is unrestrained so that leg movement is permitted in the heel direction beyond the forward lean position.

In one illustrative embodiment as shown in FIGS. 5–6 and 10–11, the ride/relax actuator is integrated with the forward lean adjuster 46. The ride/relax actuator includes a lever 68 that is coupled to the adjustable block 52 with a link 70 in an over-center arrangement to ensure that the actuator does not inadvertently release from the ride mode. The lever 68 includes a first end 71 that is pivotally connected to the lower portion 28 of the back member along a first axis 72 and a second end 74 that is configured to be grasped by a rider to actuate the lever about the first axis. A first end 78 of the link is pivotally connected to the lever 68 about a second axis 80 located between the ends of the lever. A second end 82 of the link is pivotally connected to the adjustable block 52 about a third axis 84. The lever 68 and the link 70 may be pivotally connected about their respective axes using any suitable fastener, such as a pin, screw, rivet and the like.

A forward lean angle may be selected by adjusting and securing the block 52 to the forward lean mount 58 in a desired position. The highback 20 is placed in the ride mode by actuating the lever 68 about the first axis 2 toward the upper portion so that the link 70 forces the first and third axes 2, 84 apart a first distance, thereby driving the upper portion 30 of the back member in the toe direction and into the forward lean position. The highback 20 is placed in the relax mode by actuating the lever 68 about the first axis 2 away from the upper portion so that the first and third axes 2, 84 may be spaced a second distance apart that is less than the first distance, thereby allowing the upper portion 30 to move in the heel direction beyond the forward lean position.

Forces are transmitted to and from a board through the highback allowing a rider to efficiently control the board through leg movement. In one illustrative embodiment as shown in FIGS. 1 and 5–6, the lower portion 28 of the back member includes a rearwardly extending abutment 86 that is configured to engage a portion of the binding, such as the heel hoop 56, to transmit forces from the highback to the binding. As shown, the abutment 86 is located in close proximity to the upper edge of the lower portion 28 adjacent the aperture 40. The lower end 50 of the forward lean adjuster is connected to the abutment 86 so that forces exerted against the upper portion 30 of the back member are transmitted through the forward lean adjuster 46 to the abutment and into the heel hoop.

In one illustrative embodiment, the abutment 86 includes an elongated lip that extends in a lateral direction across a substantial width of the back member for engaging the heel hoop. The elongated lip reduces stresses in the heel hoop, relative to configurations that apply forces on a limited portion of the heel hoop, by distributing the forces exerted against the highback over a relatively large portion of the heel hoop. This configuration allows the heel hoop 56 to be constructed with a thinner structure relative to a comparable heel hoop that supports more concentrated forces. A thinner heel hoop can decrease the distance that the binding extends behind the heel of a rider, since the rear surface of the heel hoop can be brought closer toward the rider's heel, thereby reducing the potential for binding contact with the snow during heelside turns. It is to be appreciated, however, that the abutment may be configured in any suitable manner capable of engaging with and transmitting forces to the heel hoop.

Figure 12:
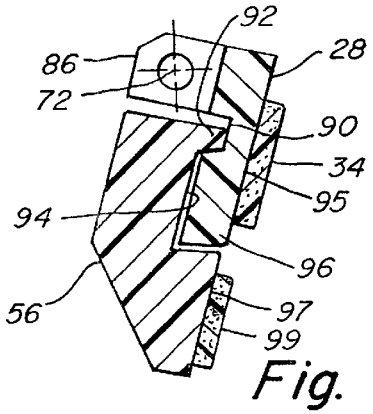
FIG. 12 is a cross-sectional view taken along section line 12—12 of FIG. 1 illustrating one illustrative embodiment of a locking arrangement for the highback to prevent toe-edge travel.

The highback 20 may be provided with a locking feature that engages with a corresponding locking feature on a binding to lock the highback in an upright riding position to prevent toe-edge travel, such as pivoting of the highback in the toe direction when riding, relative to the board for enhanced board response. In one illustrative embodiment as shown in FIGS. 1 and 12, a detent arrangement is employed between the highback 20 and the binding that allows a rider to readily snap the highback into and out of the riding position. As illustrated, the detent includes an elongated groove 90 extending laterally across the rear face of the lower portion 28 and a corresponding catch 92 extending generally in the toe direction from the inner surface of the heel hoop 56 of the binding. The groove 90 and the catch 92 may be configured to allow lateral rotation of the highback about a substantially vertical axis relative to a board.

When the highback 20 is pivoted to the upright riding position (FIG. 12), the catch 92 is received within the groove 90 to restrain the lower portion 28 of the highback from pivoting about the mounting axis 26 in the toe direction, thereby preventing toe-edge travel of the highback. The highback may be rotated forward into a collapsed position for transport and storage by pushing or pulling the highback with sufficient force to disconnect the catch 92 from the groove 90, when the rider's boot is removed from the binding.

To accommodate lateral rotation of the highback 20, the length of the catch 92 is less than the length of the groove 90 in the lateral direction. In one embodiment, the length of the catch 92 is approximately ⅓ the length of the groove 90. It is to be appreciated, however, that any suitable configuration may be implemented to accommodate a desired amount of lateral rotation.

By employing a detent arrangement to prevent toe-edge travel, the distance that the binding extends rearwardly behind the heel of a rider may be decreased by providing a highback and heel hoop configuration absent external structures that could protrude from the rear of the binding and potentially contact the snow during heelside turns.

The distance that the binding extends rearwardly behind a rider's heel may also be decreased by nesting the highback within the heel hoop. As illustrated in FIG. 12, a recess 94 may be provided in the heel hoop 56 below the catch 92 to receive a bottom segment 96 of the lower portion 28 of the back member. The recess 94 may be configured to receive the bottom segment 96 so that the forward facing surfaces 95, 97 of the lower portion 28 and the heel hoop 56, respectively, are substantially flush with each other, thereby allowing the heel hoop to be drawn closer to the rider's heel since the thickness of the highback between the rider's heel and the heel hoop has been substantially eliminated. A resilient pad 99 may be provided on the heel hoop surface 97 below the bottom segment of the lower portion to increase heel hold between the boot and the heel hoop.

The highback 20 may be formed with any suitable material, including a plastic materials such as polycarbonate, polyurethane, polyolefin, polyurethane, nylon and the like, that is capable of providing efficient force transmission from the rider to the board. One example of a suitable material for the highback is a Hivalloy resin available from Montell Polyolefins of Wilmington, Delaware. The forward lean adjuster components may be formed with stiff, high strength materials, such as aluminum and the like.

The highback may be injection molded as a unitary structure from a plastic material. In one embodiment, the highback is molded with the upper portion positioned in a minimum forward lean angle relative to the lower portion. In this manner, the upper portion will tend to return to the minimum forward lean angle when the highback is placed in the relax mode.

It is also contemplated that the highback may be formed from two or more materials to provide varying degrees of stiffness throughout the highback. For example, while a high degree of rigidity may be desirable in the upper portion 30 of the support member to ensure force transmission, more flexibility may be preferred in the lower regions of the highback to facilitate lateral rotation of the highback on the snowboard component. In one embodiment, the upper portion may be formed with a lightweight, stiff composite material and the lower portion may be formed of a flexible plastic. One example of a suitable composite material includes TEPEX Flowcore available from Bond-Laminates of Trossingen, Germany. Other suitable materials may include fiber-reinforced plastics, such as CELSTRAN and the like.

While several examples are described above, it is to be appreciated that the highback may be fabricated with any suitable material using any suitable manufacturing process as would be apparent to one of skill in the art.

The highback 20 according to the present invention may be employed in any gliding board activity, such as snowboarding, that would benefit from heelside support. For ease of understanding, however, and without limiting the scope of the invention, the inventive highback is now described below in connection with a snowboard binding.

Figure 13:
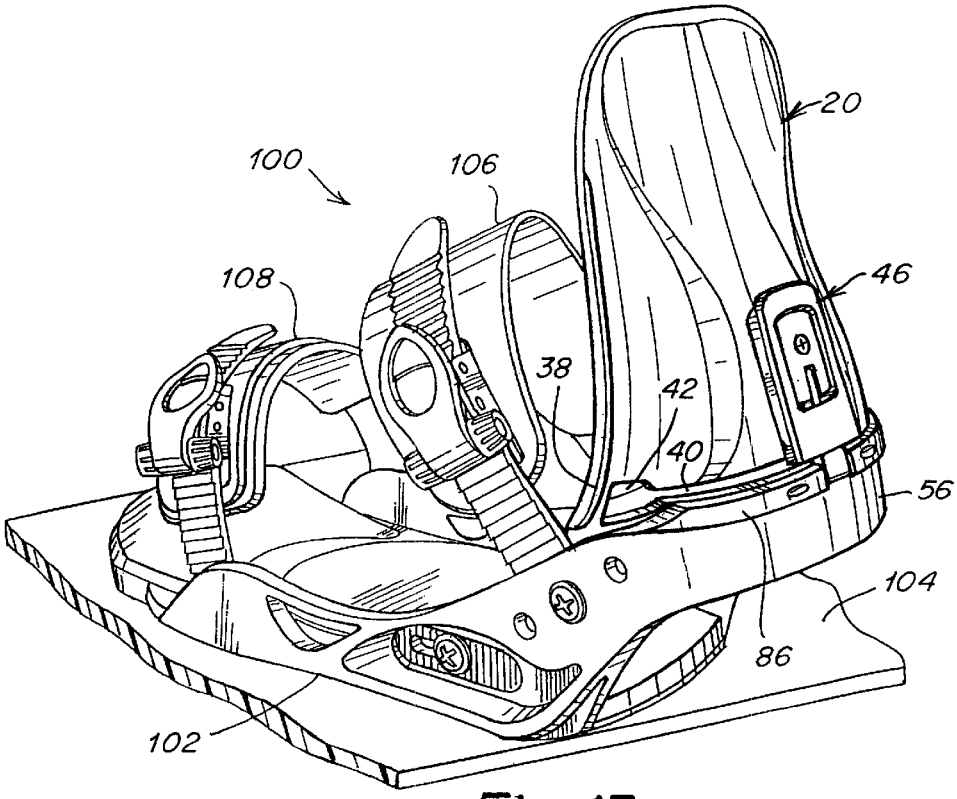
FIG. 13 is a perspective view of the highback incorporated with an illustrative embodiment of a snowboard binding according to another aspect of the invention.

In an illustrative embodiment shown in FIG. 13, the snowboard binding 100 may include a baseplate 102, which is mountable to a snowboard 104, and one or more binding straps, preferably adjustable straps, that are attached to the baseplate for securing a boot (not shown) to the snowboard. The highback 20 is pivotally mounted to the sidewalls of the baseplate 102. As illustrated, the binding 100 may include an ankle strap 106 that extends across the ankle portion of the boot to hold down the rider's heel and a toe strap 108 that extends across and holds down the front portion of the boot. It is to be understood, however, that the binding 100 may employ other strap configurations.

The highback 20 of the present invention, however, is not limited to any particular type of binding. The highback may also be implemented with a step-in snowboard binding that includes a locking mechanism that engages corresponding features provided, either directly or indirectly, on a snowboard boot. As illustrated in one embodiment shown in FIG. 14, the highback 20 may be mounted to a binding baseplate 120 in a manner similar to the binding described above. Mounted to the baseplate 120 is a pair of movable engagement members 122, each including a pair of spaced apart engagement lobes 124 that are adapted to mate with corresponding recesses 126 provided in the binding interface 128 of the boot 130 (shown in phantom). Each movable engagement member 126 also includes a trigger 132,that causes the engagement lobes 124 to move into engagement with the recesses 126 when the binding interface is placed on the baseplate.

Figure 14:
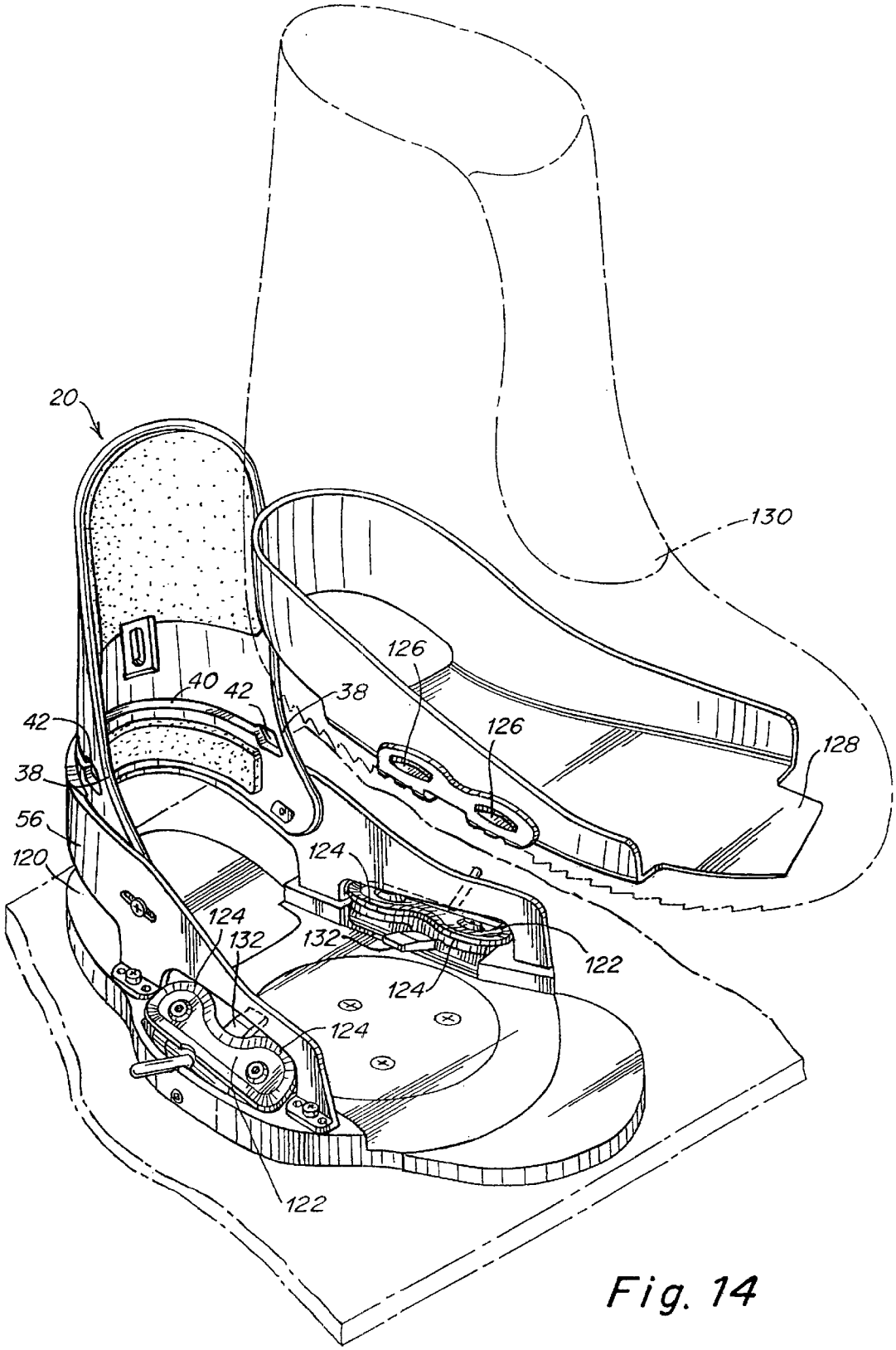
FIG. 14 is a perspective view of the highback incorporated with an illustrative embodiment of a step-in snowboard binding according to another aspect of the invention.

The particular binding shown in FIG. 14 is described in greater detail in U.S. patent application Ser. No. 08/780,721, now U.S. Pat. No. 6,123,354 which is incorporated herein by reference. An alternate step-in binding that may incorporate the highback is described in U.S. Pat. No. 5,722,680, which is also incorporated herein by reference.

Figure 15:
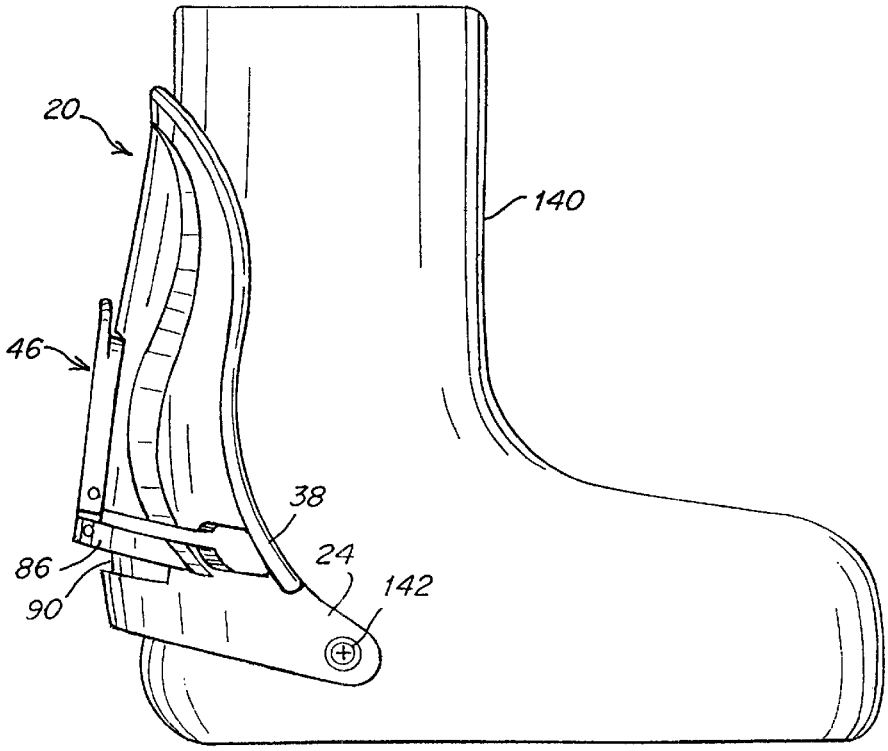
FIG. 15 is a side view of the highback incorporated with an illustrative embodiment of a snowboard boot system according to a further aspect of the invention.

In another embodiment, the highback 20 of the present invention may be either permanently attached to or removable from a snowboard boot. A removable highback provides system flexibility by allowing the boot to be implemented with binding systems that already include a highback mounted to a binding baseplate. As illustrated in FIG. 15, the highback 20 is movably mounted to the heel region of a boot 140. The lateral ears 24 are preferably attached below the ankle portion of the boot for facilitating lateral or side-to-side boot flexibility that allows desirable lateral foot roll. The lateral ears 24 may be attached to the boot, preferably at reinforced attachment points, using any suitable fastener 142, such as a screw, rivet or the like, that passes through each lateral ear.

In another aspect of the invention, the highback 20 may be implemented with a detachable binding interface system for interfacing a boot to a binding. As illustrated in one embodiment shown in FIG. 16, the interface 150 includes a body 152 and at least one adjustable strap 154 that is arranged to be disposed across the ankle portion of the boot 156, which is shown in phantom. The highback 20 is movably mounted to the sidewalls of the interface body 152 using a suitable fastener 155 that passes through the lateral ears 24 of the highback. The body 152 of the interface may include one or more mating features 158, as would be apparent to one of skill in the art, that are adapted to engage corresponding engagement members 160 on the binding 162.

Figure 16:
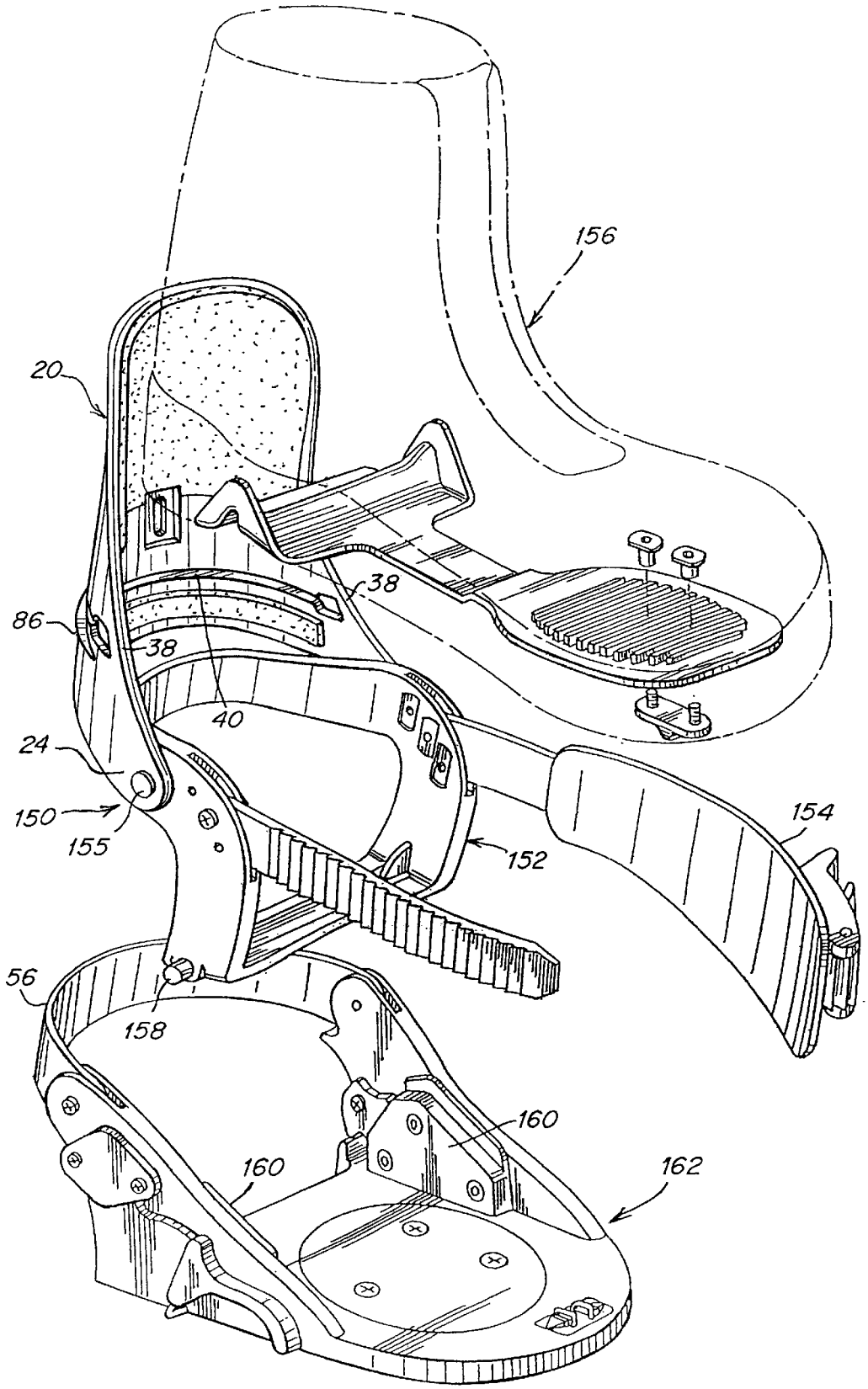
FIG. 16 is a perspective view of the highback incorporated with an illustrative embodiment of a detachable binding interface according to another aspect of the invention.

The particular binding interface 150 and binding 162 shown in FIG. 16 are described in greater detail in a U.S. application Ser. No. 09/062,131, which is incorporated herein by reference.

For ease of understanding, and without limiting the scope of the invention, the inventive highback to which this patent is addressed has been discussed particularly in connection with a boot or binding that is used in conjunction with a snowboard. It should be appreciated, however, that the present invention may be used in association with other types of gliding boards. Thus, for purposes of this patent, "gliding board" refers generally to specially configured boards for gliding along a terrain such as snowboards, snow skis, water skis, wake boards, surf boards and other board-type devices which allow a rider to traverse a surface.

Having described several embodiments of the invention in detail, various modifications and improvements will readily occur to those skilled in the art. Such modifications and improvements are intended to be within the spirit and scope of the invention. Accordingly, the foregoing description is by way of example only and is not intended as limiting. The invention is limited only as defined by the following claims and their equivalents.

What is claimed is:

1. A highback for use with a gliding board component that interfaces with a rider's leg and is supportable by a gliding board, the highback comprising:

an upright support member constructed and arranged to support a rear portion of the rider's leg, the support member including a lower portion and an upper portion movably supported by the lower portion, the lower portion constructed and arranged to be pivotally mounted to the gliding board component to allow the highback to pivot in a heel-to-toe direction, the upper portion being adjustable relative to the lower portion in a plurality of angular positions independent of the gliding board component so as to vary an amount of forward lean of the highback when the highback is mounted to the gliding board component; and a forward lean adjuster attached to the upper portion to maintain the upper portion in a selected one of the plurality of positions to fix the amount of forward lean of the highback.

2. The highback according to claim 1, wherein the lower portion is pivotally mountable to the gliding board component about a mounting axis, and wherein the upper portion is pivotally attached to the lower portion about a forward lean axis that is spaced from the mounting axis.

3. The highback according to claim 2, wherein the upper and lower portions are integrally formed as a unitary structure, the upper portion being pivotally connected to the lower portion with at least one living hinge.

4. The highback according to claim 3, wherein the support member has an aperture extending in a lateral direction between the upper and lower portions, the at least one living hinge including a pair of living hinges disposed at opposing ends of the aperture.

5. The highback according to claim 4, wherein the aperture includes an elongated slot extending through the support member.

6. The highback according to claim 2, wherein the upper portion is pivotally connected to the lower portion with at least one fastener along the forward lean axis.

7. The highback according to claim 1, wherein the forward lean adjuster is coupled to the lower portion to maintain the amount of forward lean of the highback independent of the gliding board component.

8. The highback according to claim 7, wherein the forward lean adjuster is pivotally connected to the lower portion.

9. The highback according to claim 8, wherein the forward lean adjuster includes an adjustable block mounted to the upper portion and a link coupling the adjustable block to the lower portion.

10. The highback according to claim 9, wherein the forward lean adjuster further includes a lever pivotally connected to the lower portion, the link being pivotally attached to the lever, the lever being movable between a first position and a second position, the upper portion being prevented from moving in a heel direction beyond the forward lean position when the lever is moved to the first position, the upper portion being unrestrained in the heel direction so that movement of the upper portion is permitted beyond the forward lean position when the lever is moved to the second position.

11. The highback according to claim 10, wherein the forward lean adjuster is configured as an over-center arrangement.

12. The highback according to claim 1, wherein the lower portion includes an abutment extending therefrom in a heel direction, the abutment being constructed and arranged to engage a portion of the gliding board component to transmit forces from the highback to the gliding board.

13. The highback according to claim 12, wherein the abutment includes an elongated lip extending in a lateral direction across a portion of the lower portion.

14. The highback according to claim 13, wherein the forward lean adjuster is pivotally attached to the abutment.

15. The highback according to claim 1, wherein the lower portion includes a first locking feature that is constructed and arranged to engage with a second locking feature on the gliding board component to lock the highback in an upright riding position to prevent toeedge travel relative to the gliding board.

16. The highback according to claim 15, wherein the first and second locking features form a detent.

17. The highback according to claim 16, wherein the first locking feature includes an elongated groove extending in a lateral direction across a rear face of the lower portion and the second locking feature on the gliding board component includes a catch, the groove being adapted to receive the catch.

18. The highback according to claim 1, further comprising a pair of lateral ears supported on opposing sides of the lower portion to mount the highback to the gliding board component.

19. The highback according to claim 1, wherein the lower portion includes a heel cup configured to hold a heel portion of a boot, the upper portion including a lower edge that is disposed in close proximity to the heel cup.

20. The highback according to claim 1, wherein the gliding board is a snowboard and the gliding board component is a snowboard component.

21. The highback according to claim 20, in combination with the snowboard component, the highback being mounted on the snowboard component.

22. The combination according to claim 21, wherein the snowboard component includes a snowboard binding having a baseplate, the highback being pivotally mounted to the baseplate.

23. The combination according to claim 22, wherein the snowboard binding includes at least one adjustable strap mounted to the baseplate to secure a snowboard boot.

24. The combination according to claim 22, wherein the snowboard binding is a step-in binding.

25. The highback according to claim 1, wherein the upper portion is pivotally supported by the lower portion.

26. A combination comprising:

a snowboard component; and a highback for use with the snowboard component that interfaces with a rider's leg and is supportable by a snowboard, the highback comprising:

an upright support member constructed and arranged to support a rear portion of the rider's leg, the support member including a lower portion and an upper portion movably supported by the lower portion, the lower portion being constructed and arranged to mount the highback to the snowboard component, the upper portion being adjustable relative to the lower portion in a plurality of positions to vary an amount of forward lean of the highback; and a forward lean adjuster attached to the upper portion to maintain the upper portion in a selected one of the plurality of positions to fix the amount of forward lean of the highback;

wherein the snowboard component includes a snowboard boot, the highback being pivotally mounted to the snowboard boot.

27. A combination comprising:

a snowboard component; and a highback for use with the snowboard component that interfaces with a rider's leg and is supportable by a snowboard, the highback comprising:

an upright support member constructed and arranged to support a rear portion of the rider's leg, the support member including a lower portion and an upper portion movably supported by the lower portion, the lower portion being constructed and arranged to mount the highback to the snowboard component, the upper portion being adjustable relative to the lower portion in a plurality of positions to vary an amount of forward lean of the highback; and a forward lean adjuster attached to the upper portion to maintain the upper portion in a selected one of the plurality of positions to fix the amount of forward lean of the highback;

wherein the snowboard component includes a detachable binding interface that is constructed and arranged to interface a snowboard boot with a snowboard binding, the highback being pivotally mounted to the binding interface.

28. A highback for use with a gliding board component that interfaces with a rider's leg and is supportable by a gliding board, the highback comprising:

an upright support member constructed and arranged to support a rear portion of the rider's leg, the support member including a lower portion and an upper portion articulated on the lower portion for movement therebetween, the lower portion constructed and arranged to be pivotally mounted to the gliding board component to allow the highback to pivot in the heel-to-toe direction; and a ride/relax actuator coupled to the support member, the ride/relax actuator having a ride mode and a relax mode, wherein the upper portion is fixed in a predetermined forward lean position relative to the lower portion, when the ride/relax actuator is placed in the ride mode, to prevent leg movement in a heel direction beyond the forward lean position so that leg movement in the heel direction is transmitted through the highback into the gliding board component, and wherein the upper portion is unrestrained relative to the lower portion, when the ride/relax actuator is placed in the relax mode, so that leg movement is permitted in the heel direction beyond the forward lean position.

29. The highback according to claim 28, wherein the lower portion is pivotally mountable to the gliding board component about a mounting axis, and wherein the upper portion is pivotally attached to the lower portion about a forward lean axis that is spaced from the mounting axis.

30. The highback according to claim 29, wherein the upper and lower portions are integrally formed as a unitary structure, the upper portion being pivotally connected to the lower portion with at least one living hinge.

31. The highback according to claim 30, wherein the support member has an aperture extending in a lateral direction between the upper and lower portions, the at least one living hinge including a pair of living hinges disposed at opposing ends of the aperture.

32. The highback according to claim 31, wherein the aperture includes an elongated slot extending through the support member.

33. The highback according to claim 29, wherein the upper portion is pivotally connected to the lower portion with at least one fastener along the forward lean axis.

34. The highback according to claim 28, wherein the ride/relax actuator, when placed in the ride mode, maintains the amount of forward lean of the highback independent of the gliding board component.

35. The highback according to claim 34, wherein the ride/relax actuator is pivotally connected to the lower portion.

36. The highback according to claim 35, wherein the ride/relax actuator includes an adjustable block mounted to the upper portion to adjust the predetermined forward lean position and a link coupling the adjustable block to the lower portion.

37. The highback according to claim 36, wherein the ride/relax actuator further includes a lever pivotally connected to the lower portion, the link being pivotally attached to the lever, the lever being movable between a first position and a second position to place the upper portion in the ride mode and the relax mode, respectively.

38. The highback according to claim 37, wherein the ride/relax actuator is configured as an over-center arrangement.

39. The highback according to claim 28, wherein the lower portion includes an abutment extending therefrom in a heel direction, the abutment being constructed and arranged to engage a portion of the gliding board component to transmit forces from the highback to the gliding board.

40. The highback according to claim 39, wherein the abutment includes an elongated lip extending in a lateral direction across a portion of the lower portion.

41. The highback according to claim 40, wherein the ride/relax actuator is pivotally attached to the abutment.

42. The highback according to claim 28, wherein the lower portion includes a first locking feature that is constructed and arranged to engage with a second locking feature on the gliding board component to lock the highback in an upright riding position to prevent toeedge travel relative to the gliding board.

43. The highback according to claim 42, wherein the first and second locking features form a detent.

44. The highback according to claim 43, wherein the first locking feature includes an elongated groove extending in a lateral direction across a rear face of the lower portion and the second locking feature on the gliding board component includes a catch, the groove being adapted to receive the catch.

45. The highback according to claim 28, fuirther comprising a pair of lateral ears supported on opposing sides of the lower portion to mount the highback to the gliding board component about the mounting axis.

46. The highback according to claim 28, wherein the lower portion includes a heel cup configured to hold a heel portion of a boot, the upper portion including a lower edge that is disposed in close proximity to the heel cup.

47. The highback according to claim 28, wherein the gliding board is a snowboard and the gliding board component is a snowboard component.

48. The highback according to claim 47, in combination with the snowboard component, the highback being mounted on the snowboard component.

49. The combination according to claim 48, wherein the snowboard component includes a snowboard boot, the highback being pivotally mounted to the snowboard boot.

50. The combination according to claim 48, wherein the snowboard component includes a detachable binding interface that is constructed and arranged to interface a snowboard boot with a snowboard binding, the highback being pivotally mounted to the binding interface.

51. The highback according to claim 28, wherein the upper portion is supported solely by the lower portion when the highback is mounted to the gliding board component.

52. A combination comprising:

a snowboard component; and a highback for use with the snowboard component that interfaces with a rider's leg and is supportable by a snowboard, the highback comprising:

an upright support member constructed and arranged to support a rear portion of the rider's leg, the support member including a lower portion and an upper portion movably supported by the lower portion, the lower portion being constructed and arranged to mount the highback to the snowboard component, the upper portion being adjustable relative to the lower portion in a plurality of positions to vary an amount of forward lean of the highback; and a ride/relax actuator coupled to the support member, the ride/relax actuator having a ride mode and a relax mode, wherein the upper portion is fixed in a predetermined forward lean position relative to the lower portion, when the ride/relax actuator is placed in the ride mode, to prevent leg movement in a heel direction beyond the forward lean position so that leg movement in the heel direction is transmitted through the highback into the snowboard component, and wherein the upper portion is unrestrained relative to the lower portion, when the ride/relax actuator is placed in the relax mode, so that leg movement is permitted in the heel direction beyond the forward lean position;

wherein the snowboard component includes a snowboard binding having a baseplate, the highback being pivotally mounted to the baseplate.

53. The combination according to claim 52, wherein the snowboard binding includes at least one adjustable strap mounted to the baseplate to secure a snowboard boot.

54. The combination according to claim 52, wherein the snowboard binding is a step-in binding.

55. A highback that is mountable to a snowboard binding baseplate having a heel hoop, the highback comprising:

an upright support member constructed and arranged to support a rear portion of a rider's leg, the highback being pivotally mountable to the baseplate;

a locking feature disposed on a rear surface of the support member that is constructed and arranged to engage with a corresponding locking feature on an inner surface of the heel hoop which faces the support member when the highback is mounted to the snowboard binding baseplate, to prevent toe-edge pivoting of the highback.

56. The highback according to claim 55, wherein the locking feature on the support member includes a portion of a detent.

57. The highback according to claim 55, wherein the highback is pivotally mounted to the baseplate about a mounting axis, and wherein the support member includes a lower portion and an upper portion that is pivotally attached to the lower portion about a forward lean axis that is spaced from the mounting axis, the locking feature being disposed on the lower portion.

58. The highback according to claim 57, further comprising a forward lean adjuster that is coupled to the upper portion and the lower portion to maintain the upper portion in a predetermined forward lean position independent of the heel hoop.

59. A highback that is mountable to a snowboard binding baseplate having a heel hoop, the highback comprising:

an upright support member constructed and arranged to support a rear portion of a rider's leg, the highback being pivotally mountable to the baseplate;

a locking feature disposed on a rear surface of the support member that is constructed and arranged to engage with a corresponding locking feature on an inne srface of the heel hoop to prevent toe-edge pivoting of the highback;

wherein the locking feature on the support member includes an elongated groove extending across a width of the support member that is adapted to receive a catch provided on the inner surface of the heel hoop.

60. The highback according to claim 59, wherein the highback is mountable to the baseplate for lateral rotation between a plurality of lateral positions, the groove being configured to receive the catch in each of the plurality of lateral positions.

* * * * *

UNITED STATES PATENT AND TRADEMARK OFFICE

CERTIFICATE OF CORRECTION

PATENT NO. : 6,554,296 B1
DATED : April 29, 2003
INVENTOR(S) : Laughlin et al.

It is certified that error appears in the above-identified patent and that said Letters Patent is hereby corrected as shown below:

Column 10,
Line 58, after "heel-to-toe direction," insert -- the upper portion being supported solely by the lower portion when the highback is mounted to the gliding board component, --.

Column 11,
Line 58, replace "toeedge" with -- toe-edge --.

Column 13,
Line 9, replace "articulated" with -- articulatedly mounted --.

Column 14,
Line 15, replace "toeedge" with -- toe-edge --.

Column 16,
Line 20, replace "inne srface" with -- inner surface --.

Signed and Sealed this

First Day of July, 2003

JAMES E. ROGAN
*Director of the United States Patent and Trademark Office*